US008444257B2

(12) United States Patent
Berry et al.

(10) Patent No.: US 8,444,257 B2
(45) **Date of Patent: *May 21, 2013**

(54) PRINTHEAD CARTRIDGE FOR RELEASABLE MOUNTING IN A PRINTER

(75) Inventors: Norman Micheal Berry, Balmain (AU); Akira Nakazawa, Balmain (AU); Kia Silverbrook, Balmain (AU)

(73) Assignee: Zamtec Ltd, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/225,462

(22) Filed: Sep. 4, 2011

(65) Prior Publication Data

US 2011/0316944 A1 Dec. 29, 2011

Related U.S. Application Data

(63) Continuation of application No. 12/339,039, filed on Dec. 19, 2008, now Pat. No. 8,025,374.

(51) Int. Cl.
*B41J 2/175* (2006.01)
*B41J 2/18* (2006.01)

(52) U.S. Cl.
USPC ..... 347/85; 347/89

(58) Field of Classification Search
None
See application file for complete search history.

(56) References Cited

U.S. PATENT DOCUMENTS

| | | | | |
|---|---|---|---|---|
| 4,591,875 | A | 5/1986 | McCann | |
| 6,041,805 | A | 3/2000 | Gydesen et al. | |
| 6,302,530 | B1 | 10/2001 | Shimada et al. | |
| 6,729,353 | B2 | 5/2004 | Nguyen | |
| 8,025,374 | B2 * | 9/2011 | Berry et al. | 347/85 |
| 2004/0085416 | A1 | 5/2004 | Kent | |
| 2005/0156981 | A1 | 7/2005 | Silverbrook et al. | |
| 2007/0126845 | A1 | 6/2007 | Silverbrook et al. | |
| 2007/0206073 | A1 | 9/2007 | Dyer et al. | |
| 2008/0049080 | A1 | 2/2008 | Hayashi et al. | |
| 2008/0231670 | A1 | 9/2008 | Brown et al. | |

FOREIGN PATENT DOCUMENTS

| | | | |
|---|---|---|---|
| JP | 57-115353 | A | 7/1982 |
| JP | 62-028577 | A | 2/1987 |

* cited by examiner

*Primary Examiner* — Geoffrey Mruk
(74) *Attorney, Agent, or Firm* — Cooley LLP

(57) ABSTRACT

A printhead cartridge for releasable mounting in a printer. The printhead cartridge includes a pagewidth printhead and an ink manifold defining multiple fluid flow paths in fluid communication with respective ink channels in the printhead. The ink manifold includes a plurality of openings for detachable connection with conduits in an interface of the printer; a plurality of shut off valves at each of the openings respectively, each shut off valve having a biasing member configured for biasing each shut off valve into an open position; an actuator biased towards a closed position by a resilient element such that the actuator holds all the shut off valves closed when in the closed position. The actuator is configured for engagement with the interface such that movement of the openings into connection with the interface simultaneously moves the actuator to an open position wherein the shut off valves are held open.

9 Claims, 15 Drawing Sheets

PRINTHEAD CARTRIDGE FOR RELEASABLE MOUNTING IN A PRINTER

CROSS REFERENCE TO RELATED APPLICATIONS

This application is a Continuation of U.S. application Ser. No. 12/339,039 filed on Dec. 19, 2008, now issued U.S. Pat. No. 8,025,374, the entire contents of which are herein incorporated by reference.

FIELD OF THE INVENTION

The present invention relates to fluidic couplings and in particular, ink couplings within inkjet printers.

CROSS REFERENCES

The following patents or patent applications filed by the applicant or assignee of the present invention are hereby incorporated by cross-reference.

| | | | | |
|---|---|---|---|---|
| 7,744,195 | 7,654,640 | 7,862,162 | 7,758,149 | 7,645,034 |
| 7,637,602 | 7,645,033 | 7,661,803 | 7,841,708 | 7,771,029 |
| 11/677,050 | 7,658,482 | 7,914,132 | 11/872,718 | 12/046,449 |
| 61/033,357 | 12/062,514 | 7,931,360 | 12/062,518 | 7,819,515 |
| 7,891,794 | 12/062,522 | 7,891,788 | 12/062,524 | 7,878,635 |
| 12/062,526 | 7,874,662 | 7,984,981 | 7,878,639 | 7,891,795 |
| 7,878,640 | 8,007,068 | 7,883,189 | 12/192,118 | 7,931,359 |
| 7,887,148 | 7,887,170 | | | |

BACKGROUND OF THE INVENTION

The Applicant has developed a wide range of printers that employ pagewidth printheads instead of traditional scanning printheads. Pagewidth designs increase print speeds as the printhead does not traverse back and forth across the page to deposit a line of an image. The pagewidth printhead simply deposits the ink on the media as it moves past at high speeds. Such printheads have made it possible to perform full colour 1600 dpi printing at speeds in the vicinity of 60 pages per minute, speeds previously unattainable with conventional inkjet printers.

The high print speeds require a large ink supply flow rate. Not only are the flow rates higher but distributing the ink along the entire length of a pagewidth printhead is more complex than feeding ink to a relatively small reciprocating printhead.

Some of the Applicant's printers provide the printhead as a user removable cartridge. This recognizes that individual ink ejection nozzles may fail over time and eventually there are enough dead nozzles to cause artifacts in the printed image. Allowing the user to replace the printhead maintains the print quality without requiring the entire printer to be replaced. It also permits the user to substitute a different printhead for different print jobs. A draft quality printhead can be installed for some low resolution documents printed at high speed, and subsequently removed and replaced with the original high resolution printhead.

A number of the Applicant's printhead cartridges do not have an inbuilt ink supply for the printhead. These printhead cartridges need to be fluidically coupled to the ink supply upon installation. The supply flowrate to the pagewidth printhead is too high for needle valves because of the narrow internal diameter. This requires the coupling conduits to be relatively large and therefore residual ink leaks freely out of the conduits once decoupled from the supply. This is typically not an issue for needle valve couplings because the surface tension at the open end of a small conduit will usually prevent leakage.

In pagewidth printhead cartridges, the leakage problem is exacerbated by the length of the ink flow paths. If the cartridge is held vertically during removal (or even held with one end slightly raised), the residual ink in the cartridge generates hydrostatic pressure at the lower end. This pressure is a strong driver for leakage and as discussed above, the large conduits provide little resistance.

Shut off valves that close upon disengagement of a fluid coupling are known and used in many devices. Unfortunately, these are unsuitable for the specific requirements of a consumable component such as an ink jet cartridge. Firstly, the ink should not contact any metal components. Reaction between the ink and metal can create artifacts in the print. Secondly, coupling the cartridge to the printer involves relatively high tolerances so that installation is fast and simple. The operation of an ink valve has much smaller tolerances to keep ink flow characteristics within specification. Coupling the printer and the cartridge in a way that also actuates the valve should not require the coupling tolerance to be reduced to that of the valve. Finally, the unit cost of consumables needs to be as low as possible. This requires design simplicity and low production costs.

SUMMARY OF THE INVENTION

Accordingly, the present invention provides an ink manifold defining multiple fluid flow paths, the ink manifold comprising:

a plurality of openings arranged for detachable connection with conduits in an interface;

a plurality of shut off valves at each of the openings respectively, the shut off valves being biased open;

an actuator biased to a closed position by a resilient element, such that the actuator holds all the shut off valves closed when in the closed position, the actuator being configured for engagement with the interface such that moving the interface into connection with the openings simultaneously moves the actuator to an open position where the shut off valves are able to open; wherein, the resilient element generates a bias greater than a combined bias exerted by the shut off valves on the actuator.

Normally, shut off valves are biased closed such that they only open by engagement with a connecting conduit. In the present invention, the individual shut off valves are biased open and only close when subjected to the dominant bias of the common actuator. This allows the common actuator to 'absorb' the large tolerances associated with connecting the cartridge into the printer, while the individual shut off valves can operate at much smaller tolerances using their own biasing means.

Preferably, the fluid flow paths are partially defined by a polymer channel molding having an arrangement of channels and a flexible polymer film sealed over the channels to seal the fluid flow paths from each other, the shut off valves being sealed within the polymer channel molding by the flexible polymer film and the actuator configured to act on an external surface of the flexible polymer film at areas adjacent the shut off valves. Heat sealing a polymer film to a plastic molding is an exceptionally cheap and effective means of providing the sealed flow paths within a fluid manifold. The flexible film allows the actuator to push on the individual shut off valves while remaining sealed from the ink. Accordingly, the actuator can be metal for strength, without the potential problems associated with direct ink contact discussed above. Preferably, the flexible sealing film is polypropylene film foil.

Preferably, the shut off valves are each resilient caps fitted to the respective peripheries of each of the openings by an integrally molded collapsible section such that the resilient cap is spaced from the opening until pressure from the actuator collapses the collapsible section and the cap seals against the opening periphery. Preferably, the shut off valves are formed from FKM synthetic rubber.

Preferably, the flexible polymer film has plastically deformed areas adjacent each of the shut off valves, the plastically deformed areas extending out of the plane of the polymer sealing film and configured to invert to accommodate movement of the shut off valves. Forming deformations in the film lets the shut off valves fully open without being restrained by the tension in the film.

Preferably, the channel molding defines a plurality of valve chambers for holding each of the shut off valves respectively, the valve chambers each connecting to one of the channels respectively, such that the channel connects to the valve chamber at a topmost section when the manifold is in use. By designing the channels to connect to their valve chambers at their most elevated points, air bubbles are not trapped in the valve chambers as the manifold primes with ink.

Preferably, the manifold is part of a printhead cartridge and the interface is in fluid communication with an ink supply. In a further preferred form, the printhead cartridge has two of the ink manifolds, one being an inlet manifold and the other being an outlet manifold, the outlet being configured for detachable connection to a second interface in fluid communication with an ink sump. Preferably, the printhead cartridge has a pagewidth printhead.

According to another aspect, the present invention provides a fluid coupling comprising:

a first conduit;

a second conduit having a seal seat and a compression member, the compression member being movable relative to the seal seat;

an annular seal positioned in the seal seat; and, an engagement mechanism for moving the second conduit from a disengaged position where there is no sealed fluid connection between the first and second conduits, and an engaged position where the compression member moves toward the seal seat to compress the annular seal to form a sealed fluid connection.

The invention uses an engagement mechanism to deform the annular seal instead of the force of one conduit being pushed into the other. The exertion needed to establish the sealed fluid coupling can be reduced or removed by incorporating mechanical advantage or power assistance into the engagement mechanism. Also there is no force acting on the first conduit so it is not subjected to structural stresses.

Preferably, the engagement mechanism moves the second conduit such that it telescopically engages the first conduit and the second conduit prior to compressing the annular seal. Preferably, the engagement mechanism is manually actuated and compresses the seal with the assistance of a lever system. Preferably, the first conduit is part of a cartridge and the second conduit is part of a device that uses the cartridge during operation, the lever system latches to the cartridge when it has moved the second conduit to the engaged position. Optionally, the first conduit slides within the second conduit during telescopic engagement. Preferably, the annular seal is a ring of resilient material. In a particularly preferred form, the ring of resilient material has a radial cross sectional shape with at least one straight side when uncompressed, and said at least one straight side bulging to a curved shape when compressed.

In some embodiments, the lever system completely disengages the second conduit from the first conduit when it moves the second conduit to the disengaged position. Preferably, the cartridge has a plurality of first conduits and the device has a corresponding plurality of second conduits, and the lever system actuates to simultaneously engage and disengage the plurality of first and second conduits. In a further preferred form, the coupling has a corresponding plurality of the annular seals for each of the second conduits respectively, wherein the compression member is arranged to compress all the annular seals respectively, the second conduits formed in an arrangement with a geometric centroid at which the lever system connects to the compression member. In a particularly preferred form, the second conduits are arranged in a circle and the lever system connects to the centre of the circle.

In some embodiments, the device is a print engine for an inkjet printer and the cartridge has an inkjet printhead. In these embodiments, it is preferable if the inkjet printhead is a pagewidth inkjet printhead such that the cartridge has an elongate configuration and the lever system has a hingedly mounted latch for releasably engaging the cartridge to secure it in the print engine when in the engaged position and allow the cartridge to be lifted from the print engine when in the disengaged position. Preferably, half of the plurality of first conduits extend from an inlet manifold at one end of the elongate cartridge, and half of the plurality of first conduits extend from an outlet manifold at the other end of the elongate cartridge.

In particular embodiments, the first conduits extend transversely to the longitudinal extent of the elongate cartridge such that the plurality of second conduits move transverse to the longitudinal extent of the elongate cartridge when moving between the engaged and disengaged positions.

Preferably, the second conduit has a shut off valve that opens when the first and second conduits are in the engaged position and closes when they are in the disengaged position.

In some preferred embodiments, the lever system has an input arm hinged to the compression member, the input arm having a compression lever fixed at an angle to the longitudinal extent of the input arm, the input arm arranged to push against the compression member as it rotates about the hinge connection to the compression member, the compression member in turn pushes against the second conduit to move it relative to the first conduit, until the input arm reaches a predetermined angle about the hinge where the compression lever engages the second conduit such that further rotation of the input arm moves the compression member relative to the second conduit to compress the annular seal.

In further preferred forms, the device has a chassis and the lever system latches the cartridge with a latch arm hinged to the chassis, the latch arm being fixed for rotation with an actuation arm hinged to the input arm, such that user actuation of the latch arm advances and retracts the second conduit and the compression member. Conveniently, the latch arm provides the longest lever arm of the lever system and so requires the least force to rotate.

BRIEF DESCRIPTION OF THE DRAWINGS

Preferred embodiments of the invention will now be described by way of example only, with reference to the accompanying drawings, in which.

DETAILED DESCRIPTION OF THE PREFERRED EMBODIMENTS

The invention will be described with specific reference to a fluid coupling between an inkjet print engine and its corresponding printhead cartridge. However, the ordinary worker will appreciate that the invention is equally applicable to other arrangements requiring a detachable fluid connection.

Figure 1:
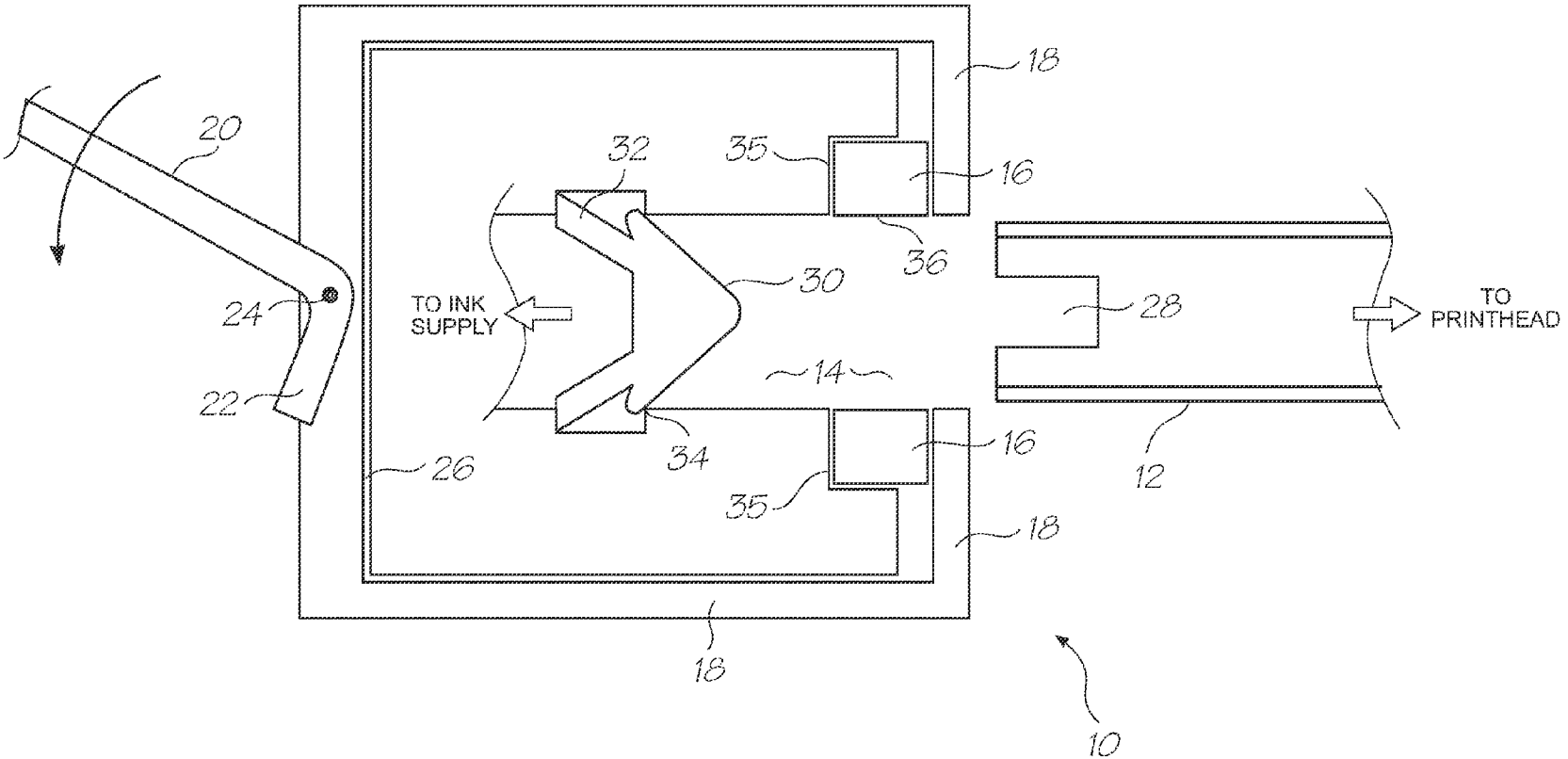
FIG. 1 is a schematic section view of a fluid coupling with the first and second conduits disengaged.

In FIG. 1, the fluid coupling 10 is shown with the first conduit 12 disengaged from the second conduit 14. The first conduit 12 leads to the pagewidth printhead of the removable printhead cartridge (described below). The second conduit 14 is connected to the ink supply (not shown) and sized such that it can telescopically engage the first conduit 12 with a sliding fit. The ink is retained by the shut off valve 30 biased against valve seat 34 by the resilient struts 32. The second conduit 14 defines a seal seat 35 for the annular seal 16. The annular seal 16 is retained in the seal seat 35 by the compression member 18. In the disengaged position shown in FIG. 1, the annular seal 16 is not compressed by the compression member 18 such that the inner surface 36 of the seal remains flat. When flat, the inner surface 36 does not to interfere with the sliding fit between the first and second conduits (12 and 14).

An input arm 20 is hinged to compression member 18. A compression lever 22 is fixed at an angle to the input arm 20. The input arm 20 and the compression lever 22 are part of a lever system described in greater detail below with reference to FIGS. 3 and 4. The lever system is an engagement mechanism that the user actuates to advance the second conduit 14 and compression member 18 onto the first conduit 12. As the input arm 20 rotates, it pushes on the hinge 24 which in turn moves the compression member 18 together with the second conduit 14.

Figure 2:
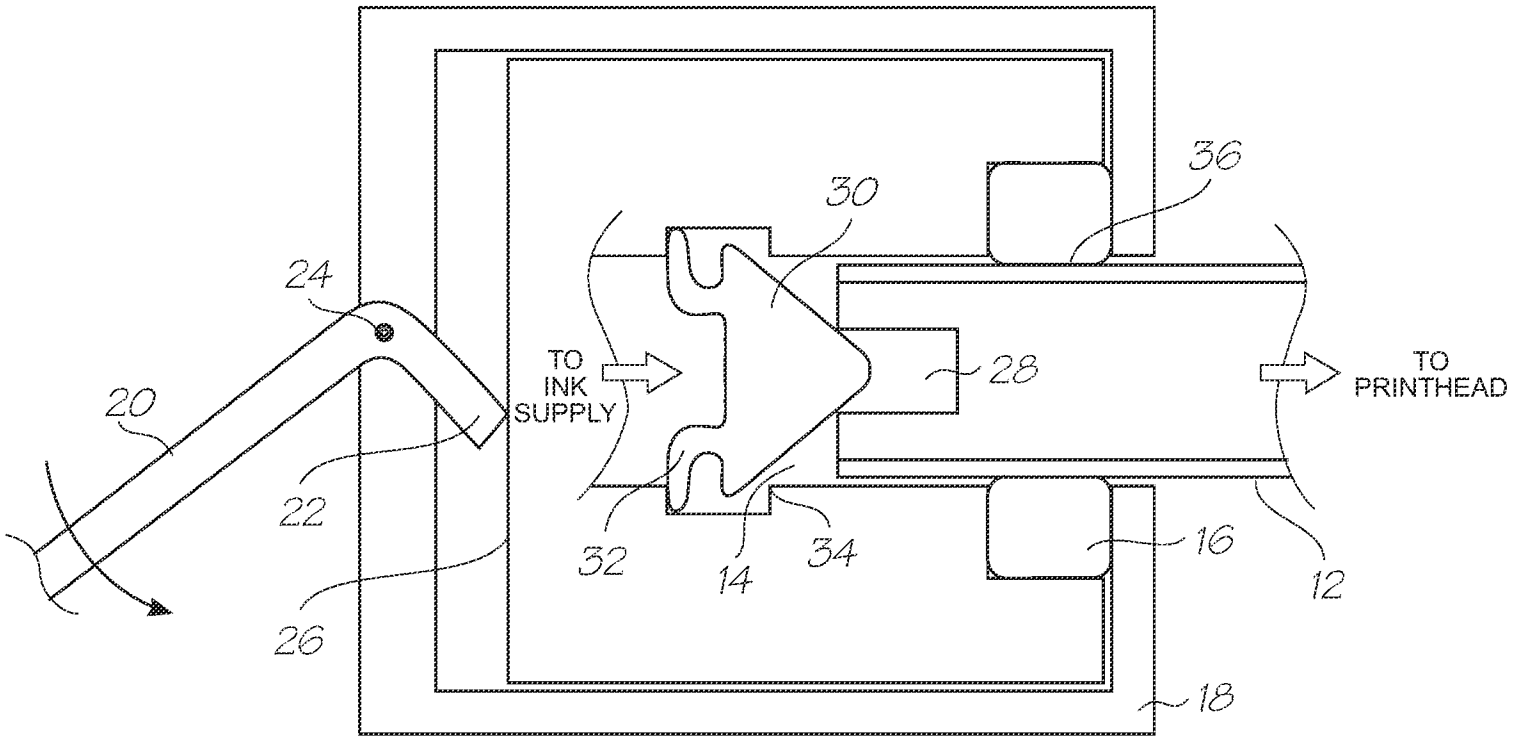
FIG. 2 is a schematic section view of a fluid coupling with the first and second conduits engaged.

As best shown in FIG. 2, the compression member 18 and the second conduit 14 advances until the input arm 20 is parallel to the direction of travel. Continued rotation of the input arm 20 brings the compression lever 22 into contact with the rear 26 of the second conduit 14. The compression lever 22 is carefully dimensioned to keep the second conduit 14 stationary relative to the first conduit 12 as the input arm 20 retracts the compression member 18 by pulling on the hinge 24. The compression member 18 compresses the annular seal 16 to force the flat inner surface 36 to bulge and form a fluid tight seal against the outside of the first conduit 12.

FIG. 2 also shows the first conduit 12 engaging the shut off valve 30 to open fluid communication between the ink supply and the printhead. The resilient struts 32 buckle with little resistance upon engagement with the end of the first conduit 12. Apertures 28 allow ink to flow around the valve member 30 and into the first conduit 12.

When the fluid coupling disengages, the input arm 20 is rotated in the opposite direction to simultaneously decompress the annular seal 16 and retract the second conduit 14 from the first conduit 12. This coupling is configured establish a sealed fluid connection with the first conduit subjected to little or no insertion force. In light of this the structure that the supports the first conduit is not overly flexed or bowed. This protects any components that are not robust enough to withstand structural deformation.

Figure 3:
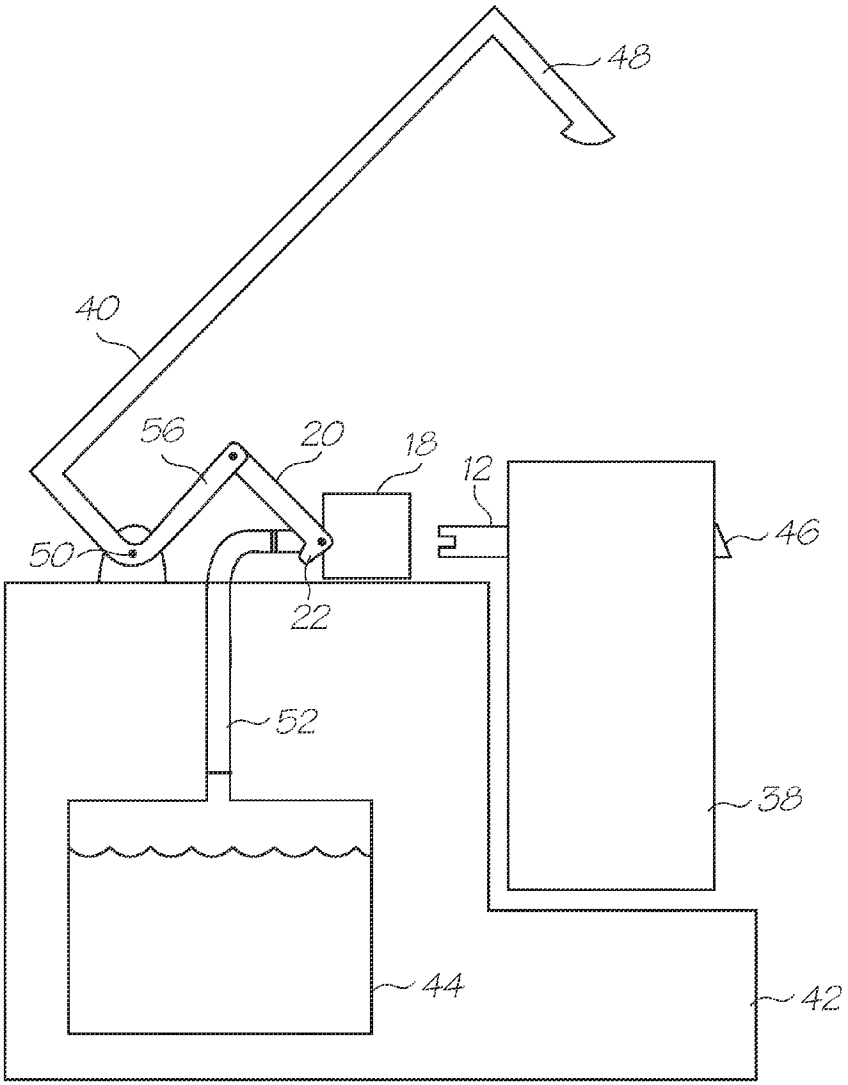
FIGS. 3 and 4 are diagrammatic sketches of the fluid coupling being used to connect a printhead cartridge and an inkjet printer.
Figure 4:
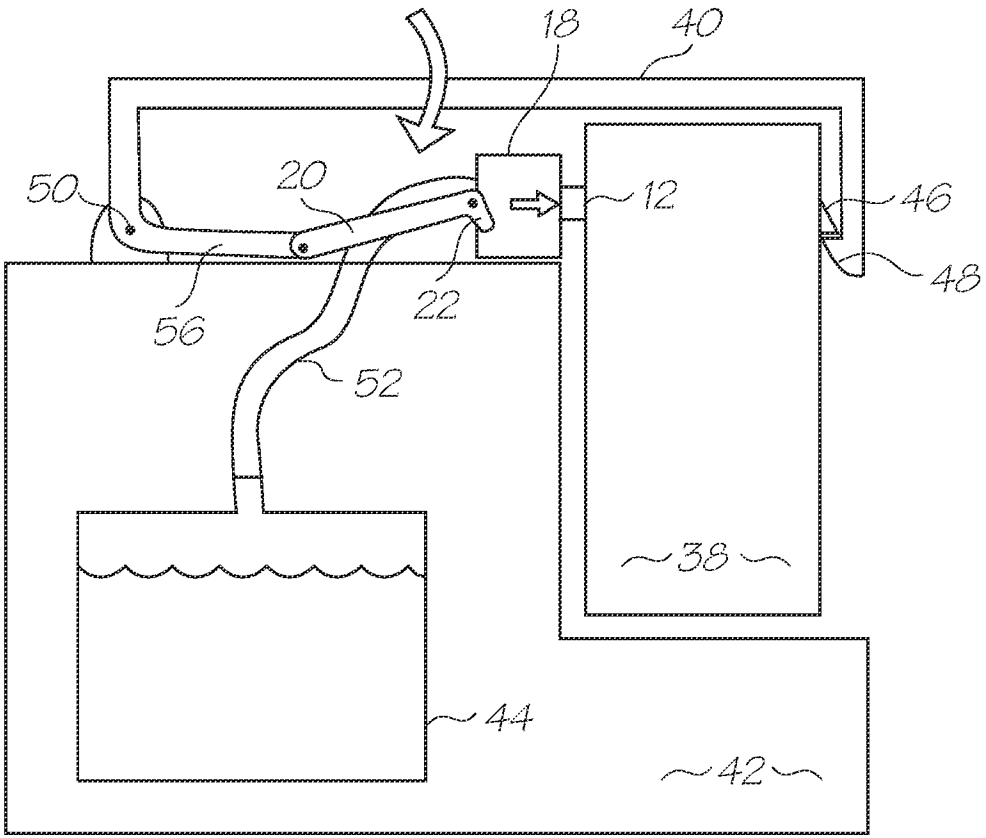

In FIGS. 3 and 4, the fluid coupling 10 is used to provide a detachable connection between the cartridge 38 and the printer 42. Referring to FIG. 3, the cartridge 38 is seated in the printer 42 such that the first conduits 12 face the compression member 18 (which covers the second conduits). The latch 40 is lifted to allow the cartridge to be installed. An actuator arm 56 is fixed relative to the latch 40 and rotates therewith about the hinge 50. The distal end of the actuator arm 56 is hinged to the input arm 20. When the latch is raised for cartridge installation or removal, the input arm 20 is likewise raised, which retracts the compression member 18 away from the first conduit 12. With the input arm in the raised and retracted position, the compression lever 22 is disengaged from the back of the second conduit (see 14 and 26 of FIG. 2). As discussed above, the annular seal is not compressed in the disengaged position so as not to interfere with the sliding fit with the first conduit.

Referring to FIG. 4, the fluid coupling 10 is engaged by simply lowering the latch 40 onto the cartridge 38 until the complementary snap-lock formations 46 and 48 engage. Actuator arm 56 rotates the input arm 20 and advances the compression member 18 towards the first conduit 12. The first conduit 12 telescopically engages the second conduit with a loose sliding fit until the actuator arm 56 and the input arm 20 are parallel to the direction of travel. When the second conduit is at its maximum engagement with the first conduit, the shut off valve is opened and the cartridge 38 is in fluid communication with ink tank 44 via the flexible tubing 52.

When the compression member is at its point of maximum travel towards the cartridge, the compression lever 22 engages the second conduit (not shown). The compression lever 22 is dimensioned to hold the second conduit stationary relative to the first conduit as the input arm 20 continues to rotate and draw the compression member 18 back to compress the seal and establish the fluid seal (see FIG. 2).

Figure 5:
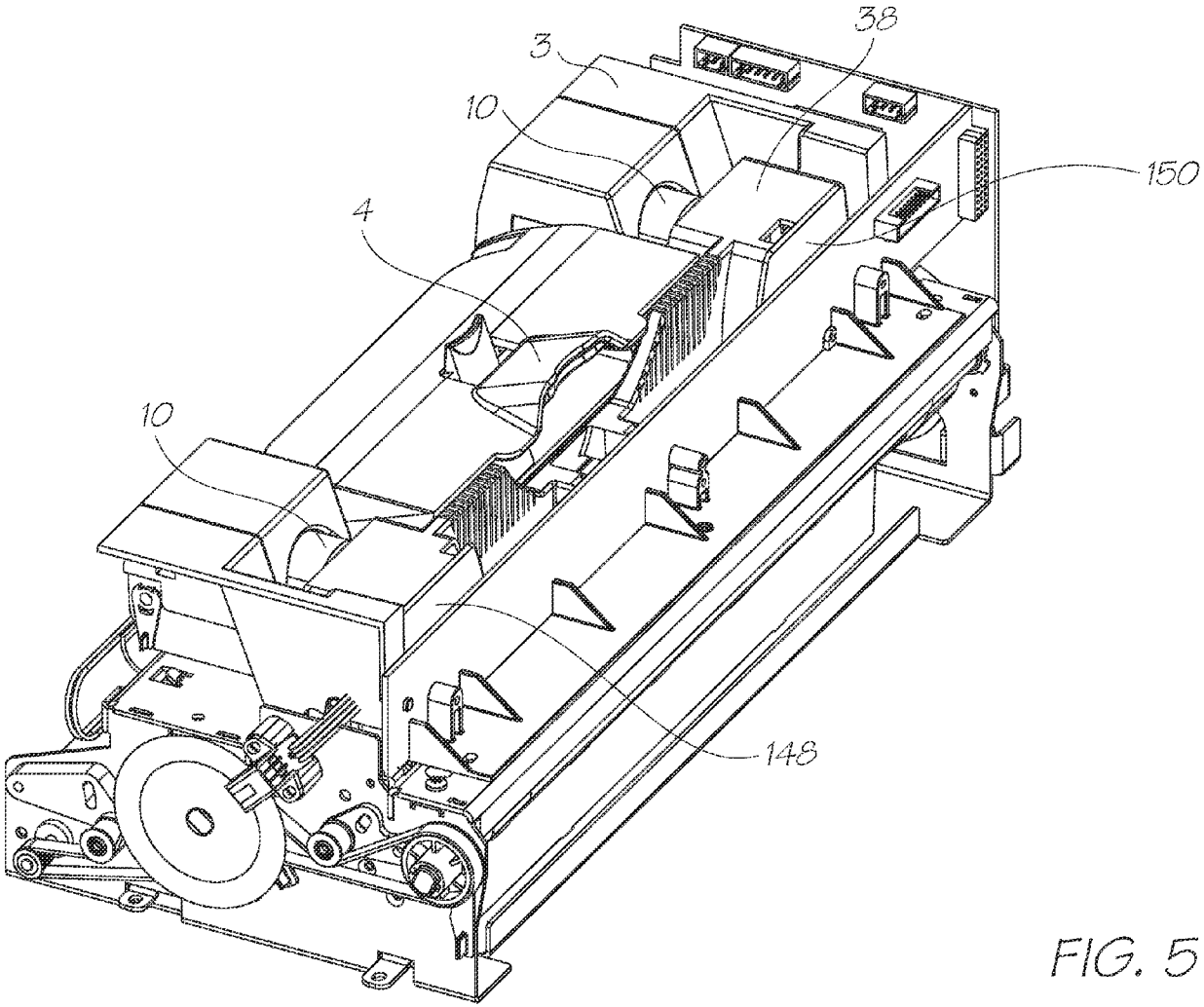
FIG. 5 is a section view of the fluid coupling being used to connect a printhead cartridge and a print engine.

FIG. 5 shows a printhead cartridge 38 installed in a print engine 3. The print engine 3 is the mechanical heart of a printer which can have many different external casing shapes, ink tank locations and capacities, as well as different media feed and collection trays. The printhead cartridge 38 is inserted and removed by the user lifting and lowering the latch 40. The print engine 3 forms an electrical connection with contacts on the printhead cartridge 38 and fluid couplings 10 are formed at the inlet and outlet manifolds, 148 and 150 respectively.

Figure 6:
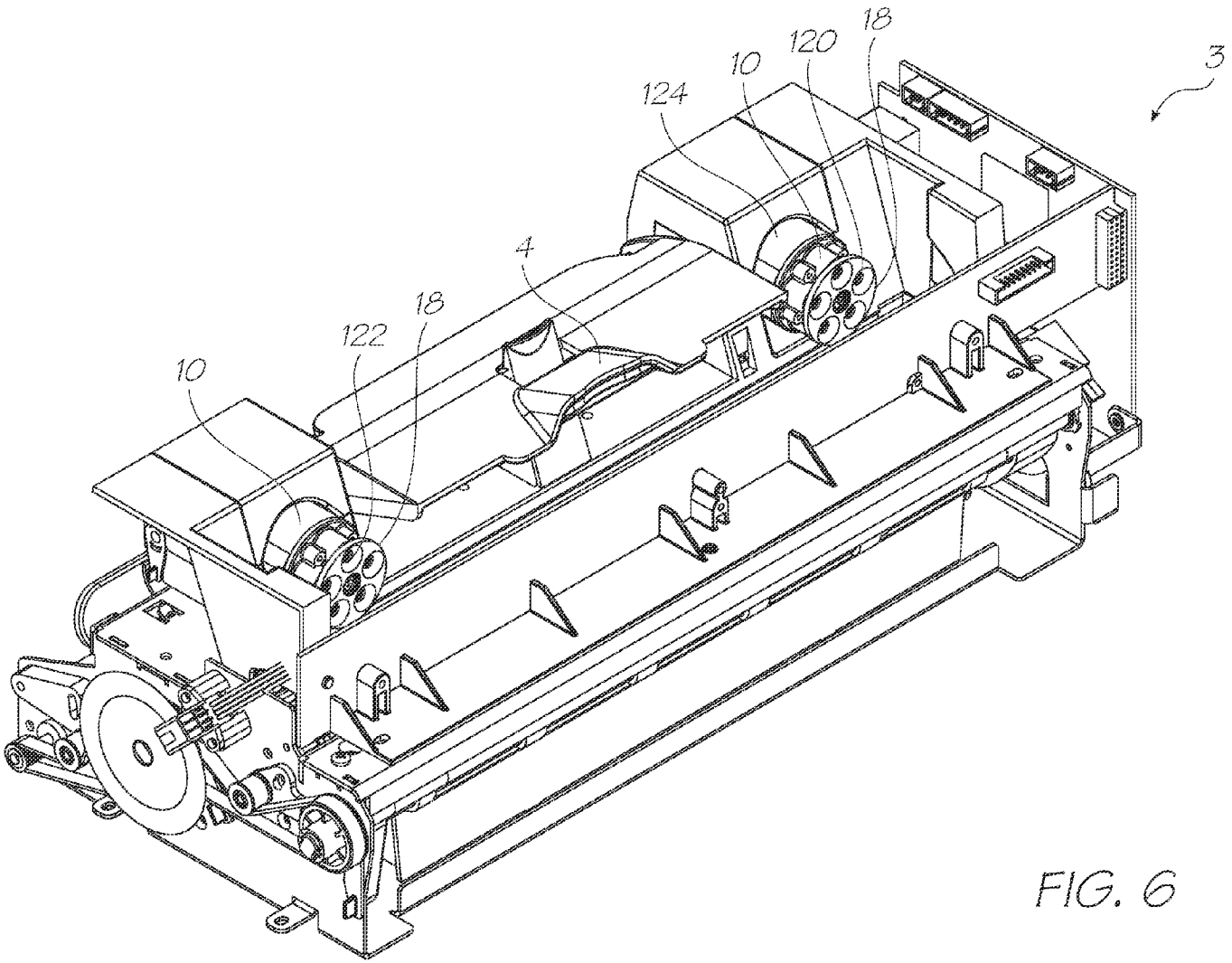
FIG. 6 is a perspective view of the print engine with the printhead cartridge.

FIG. 6 shows the print engine 3 with the printhead cartridge removed to reveal the apertures 120 in each of the compression members 18. Each aperture 120 receives one of the spouts 12 on the inlet and outlet manifolds (see FIG. 9). The spouts correspond to the first conduits 12 of the schematic representations of FIGS. 1-4. As discussed above, the ink tanks, media feed and collection trays have an arbitrary position and configuration depending on the design of the printer's outer casing.

Figure 7:
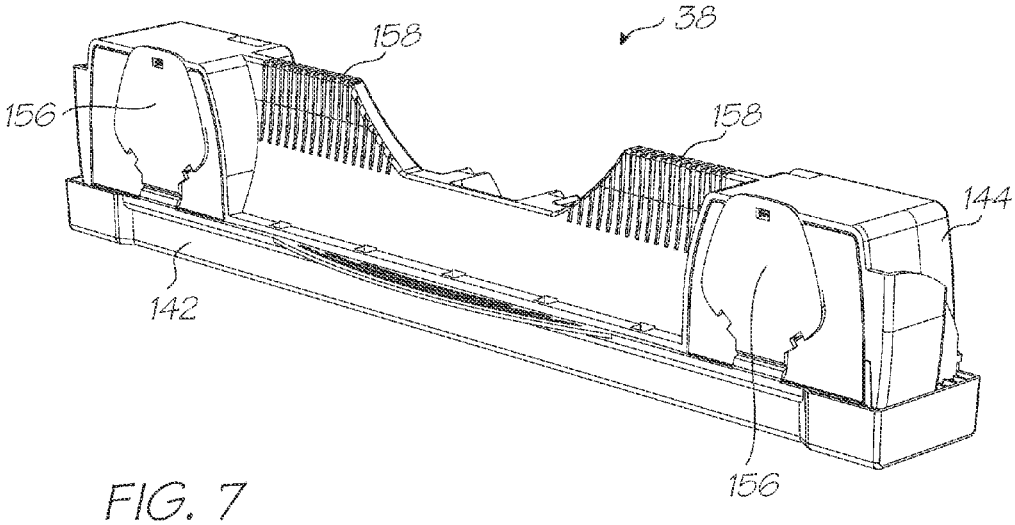
FIG. 7 is a perspective of the printhead cartridge.

FIG. 7 is a perspective of the complete printhead cartridge 38. The printhead cartridge 38 has a top molding 144 and a removable protective cover 142. The top molding 144 has a central web for structural stiffness and to provide grip textured surfaces 158 for manipulating the cartridge during insertion and removal. The base portion of the protective cover 142 protects the printhead ICs (not shown) and line of contacts (not shown) prior to installation in the printer. Caps 156 are integrally formed with the base portion to cover the inlet and outlet spouts (see 12 of FIG. 9).

Figure 8:
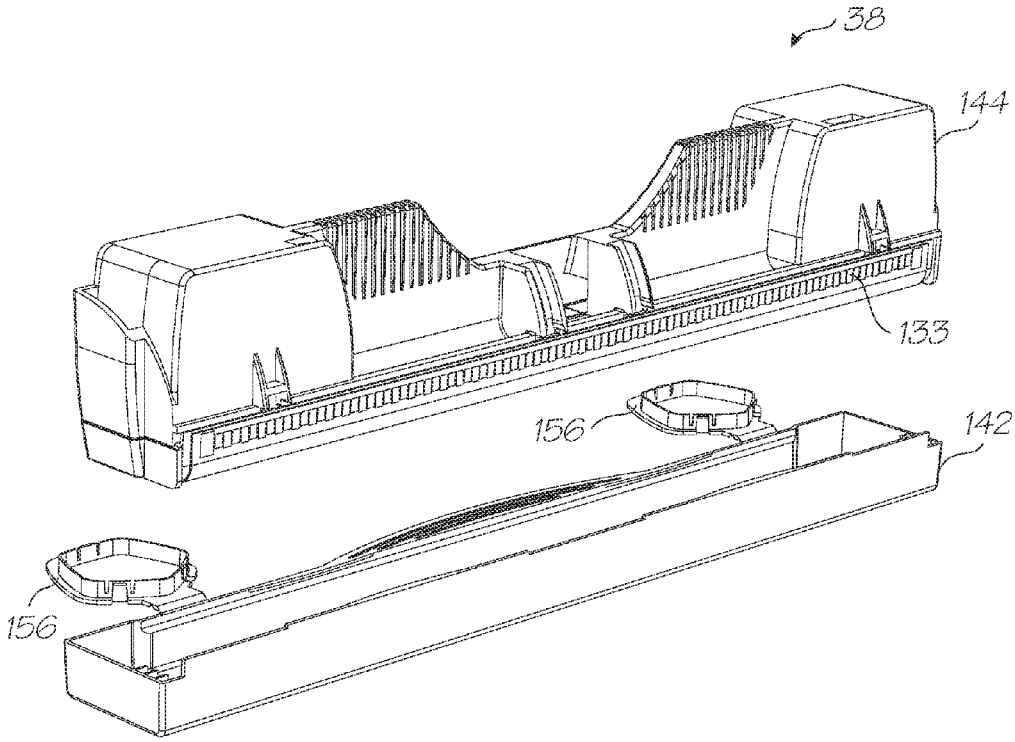
FIG. 8 shows the printhead cartridge of FIG. 7 with the protective cover removed.
Figure 9:
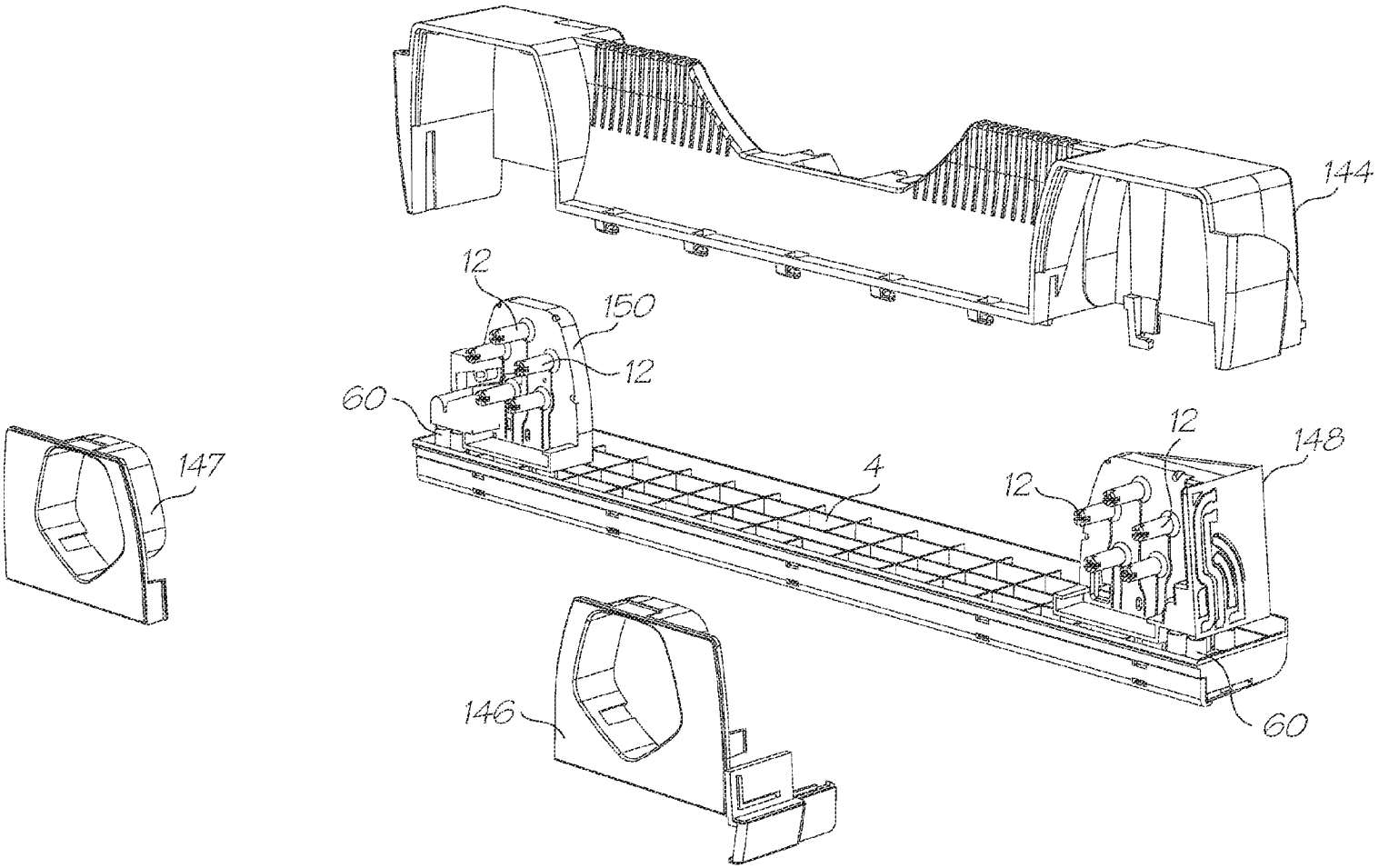
FIG. 9 is a partially exploded prospective view of the printhead cartridge of FIG. 7.

FIG. 8 shows the cartridge 38 with its protective cover 142 removed to expose the printhead ICs (see FIG. 10) on the bottom surface and the line of contacts 133 on the side surface. The protective cover is discarded to the recycling waste or fitted to the printhead cartridge being replaced to contain leakage from residual ink. FIG. 9 is a partially exploded perspective of the cartridge 38 without the protective cover. The top cover 144 has been removed reveal the inlet manifold 148 and the outlet manifold 150. The inlet and outlet shrouds 146 and 147 have been removed to expose the five inlet and outlet spouts 12. The inlet and outlet manifolds 148 and 150 feed ink to their respective connectors 60 which lead to the molded liquid crystal polymer (LCP) channels 4 that supply the printhead ICs 31 (see FIG. 10). A detailed description of the fluid flows through the cartridge 38, and the printhead assembly within it, is provided by co-pending U.S. Ser. No. 12/014,768 filed Jan. 16, 2008, the disclosure of which is incorporated herein by cross reference.

Figure 10:
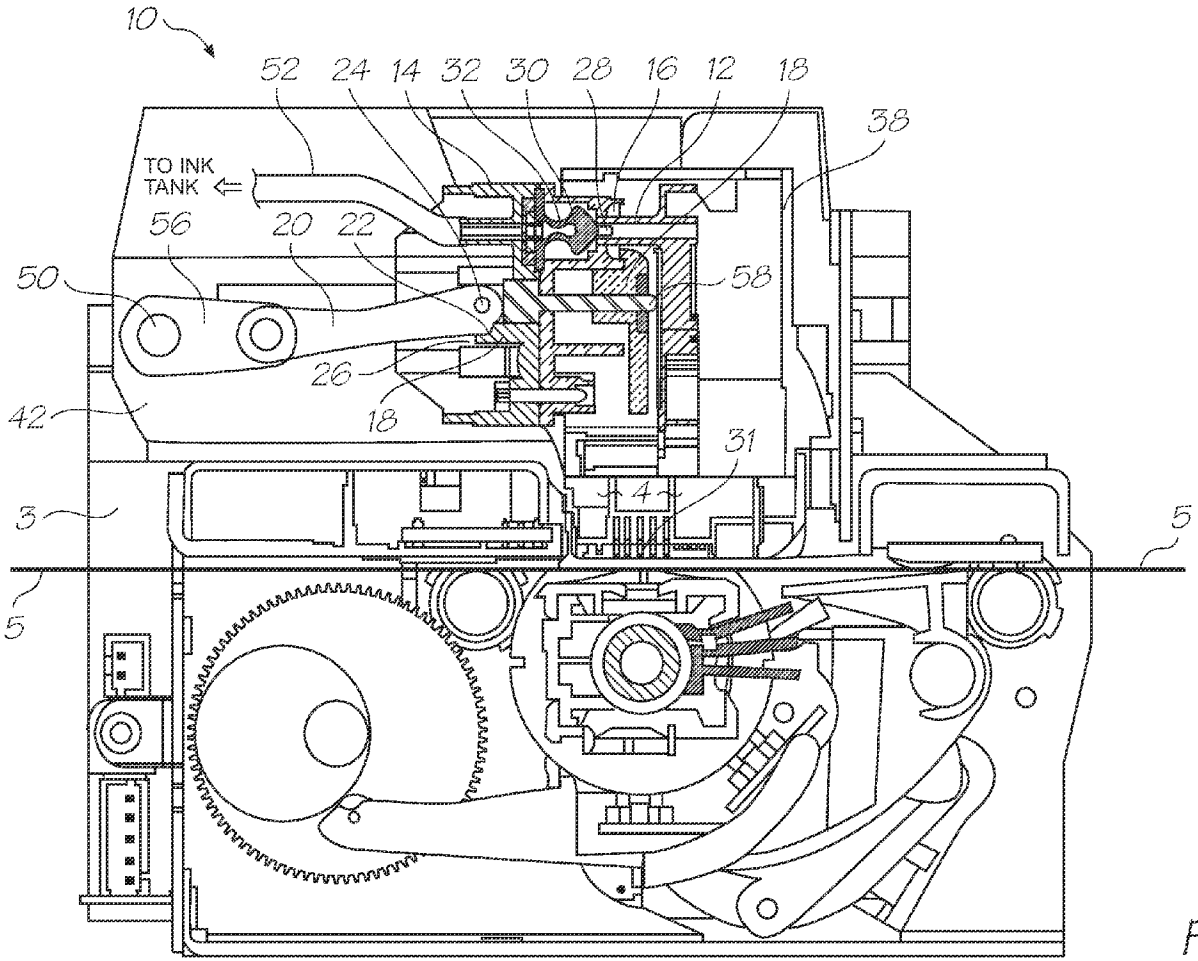
FIG. 10 is a section view of the print engine and printhead cartridge through the fluid coupling.

FIG. 10 is a section view through a fluid coupling 10 of the print engine 3 with the cartridge 38 installed. The components corresponding to the elements of the schematic representations of FIGS. 1-4 have been identified using the same reference numerals. For context, the paper path 5 is shown extending through the print engine 3 and past the printhead ICs 31.

The coupling is shown forming a sealed fluid connection between one of the spouts 12 and the one of the second conduits 14. It will be appreciated that the coupling at the inlet and outlet manifolds are identical with the exception that the ink flows from the second conduit 14 to the spout 12 at the inlet manifold and in the opposing direction at the outlet manifold. For the purposes of this description, the coupling will be described at the inlet manifold. Accordingly, flexible tubing 52 feeds ink from an ink tank (not shown) to the second conduit 14. The shut off valve 30 in the second conduit 14 is being held open by the end of the spout 12. The ink flows into the spout 12 and down to the LCP channel molding 4 where it is distributed to the printhead ICs 31.

The coupling 10 is actuated by the actuator arm 56 hinged to the print engine chassis 42 at shaft 50. As discussed above the latch 40 (not shown in FIG. 10) also extends from the shaft 50 for fixed rotation with the actuator arm 56. The actuator arm 56 rotates the input arm 20 to push the compression member 18, and in turn the second conduit 14 into telescopic engagement with the spout 12. Upon further rotation, the compression lever 22 engages the rear 26 of the second conduit 14. The input arm 20 draws back on the hinge connection 24 which in turn pulls on the central rod 58 extending to the middle of the compression member 18. The resilient seal 16 is compressed and bulges to form a fluid tight seal against the outer surface of the spout 12. It will be appreciated that the compression member 18 compresses all the annular seals 16 for each of the input spouts 12 simultaneously. Using a central rod 58 attached to the middle of the compression member 18 ensures that the compressive force on each annular seal is uniform. Furthermore, as the latch 40 is the longest lever of the lever system, the force that the user needs to apply is conveniently weak.

When the printhead cartridge 38 is to be replaced, the latch (not shown) is lifted off the cartridge to automatically rotate the actuator arm 56 upwards, thereby lifting and retracting the input arm 20. The annular seal 16 is released when the compression lever 22 swings out of engagement with the surface 26. The second conduits and the corresponding spouts 12 now have a loose sliding fit and slide easily away from each other. With the compression member 18 and the spouts 12 completely disengaged, the user simply lifts the cartridge 38 out of the print engine 3.

Ink Manifolds with Shut Off Valves

FIGS. 11 to 19 show another embodiment of the ink manifolds 148 and 150 on the printhead cartridge. As discussed above, the inlet and outlet manifolds are mirror images of each other and so only the inlet manifold 148 be described. However, the description is equally applicable to the outlet manifold 150 with the exception that the ink flow direction is opposite and the outlet manifold 150 couples to the sump instead of the ink supply.

As discussed in the Background of the Invention, the internal diameter of the spouts 12 is relatively wide (approximately 2 mm) to provide the flow rate necessary for the high ink consumption of a pagewidth printhead. However, this causes high levels of ink leakage when the printhead cartridge is removed from the printer, particularly when one end is raised and hydrostatic pressure drives the ink flow from the lower end. To avoid this, the ink manifold shown in FIGS. 11 to 19 has shut off valves for each of the spouts 12.

Figure 12:
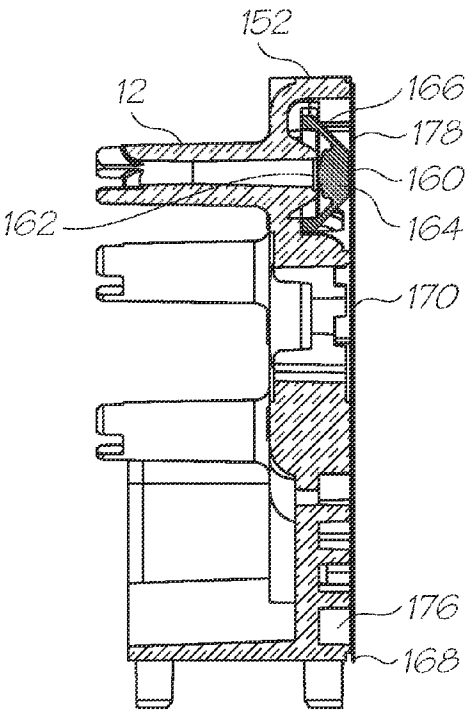
FIG. 12 is Section 12-12 shown in FIG. 11.
Figure 11:
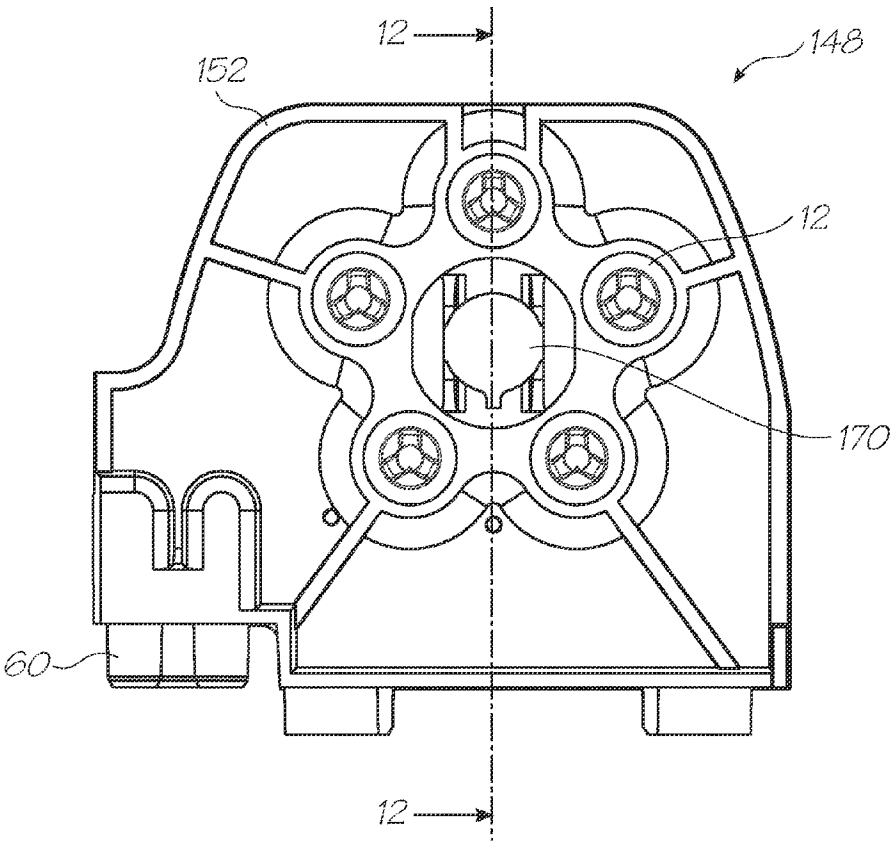
FIG. 11 is an elevation of another embodiment of the ink manifold for the printhead cartridge with the shut off valve actuator removed for clarity.

Referring to FIGS. 11 and 12, the spouts 12 extend from the front of the polymer channel molding 152. The spouts 12 and the connectors 60 are positioned in the same locations as the inlet and outlet manifolds 148 and 150 described in the previous embodiment. However, the spouts 12 each lead to an opening 162 and a shut off valve 160. The shut off valve 160 is a dish-shaped rubber molding best shown in the partial enlarged section view of FIG. 14. A central sealing cap 164 is shaped to seal the periphery of the opening 162. An integrally molded collapsible section 166 mounts to the channel molding 152 and supports the sealing cap 164 over the opening 162. The shut off valve is an FKM synthetic rubber molding with a set of compression characteristics that ensure it will consistently return to its original shape after compression.

Figure 14:
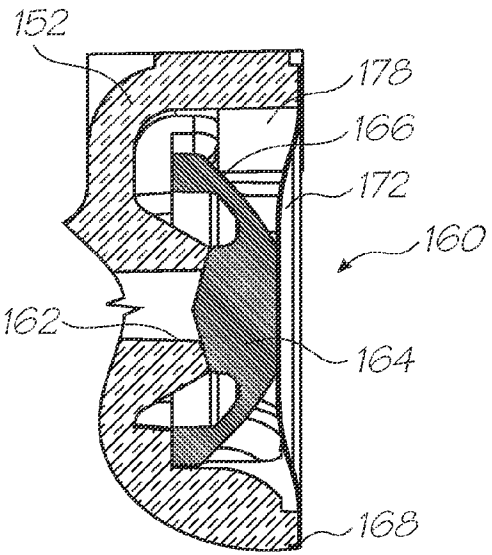
FIG. 14 is a cross section of one of the shut off valves used in the ink manifold of FIG. 11.
Figure 13:
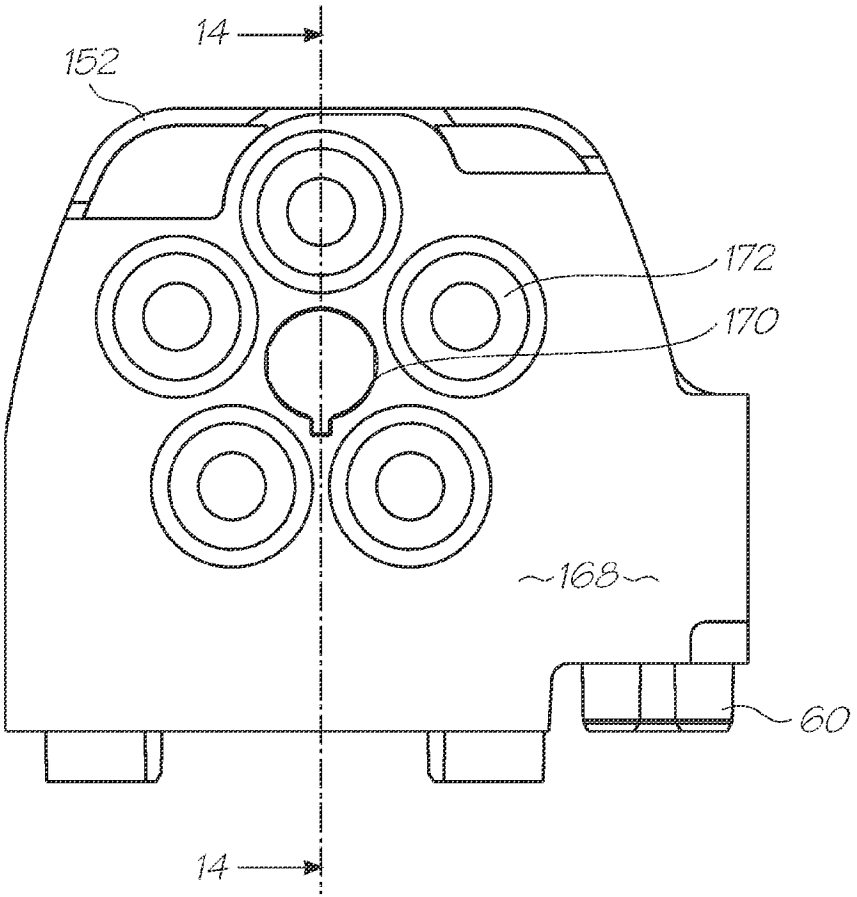
FIG. 13 is a rear elevation of the ink manifold shown in FIG. 11.

In FIG. 12, the shut off valve is shown in its uncompressed state whereby the sealing cap is spaced from the opening 162 and the valve is open. Hence the shut off valve 160 is biased to the open position. FIG. 14 shows the shut off valve 160 in its compressed state. The valve actuator that applies the compressive force to the shut off valve 160 has been omitted in the interests of clarity. Pressure from the actuator on the sealing cap 164 elastically deforms the thin collapsible section 166 that forms an annular skirt around the cap. The sealing cap 164 form a fluid seal at the opening 162 to close the valve. The sealing cap 164 is held in the closed position by the actuator, against the bias of collapsible section 166.

The rear of the channel molding 152 is sealed by a polypropylene film foil 168. This is a highly cost effective and simple method of providing a reliable fluid seal around the channels 176 and the valve chambers 178 formed by the channel molding 152. To accommodate the movement of the shut off valves 160, dome-shaped plastic deformations 172 are pressed into the sealing film 168. The deformations 172 extend inwardly, out of the plane of the sealing film 168 when the actuator 190 (see FIG. 17) is compressing the shut off valves 160. When the actuator 190 releases the shut off valves 160, the deformations 172 can invert outwardly such that the sealing film 168 does not impede the opening of the valve. Furthermore, the plastic deformations 172 ensure that the actuator or the shut off valves do not create excessive tension in the film 168 that can compromise the fluid seal.

Figure 15:
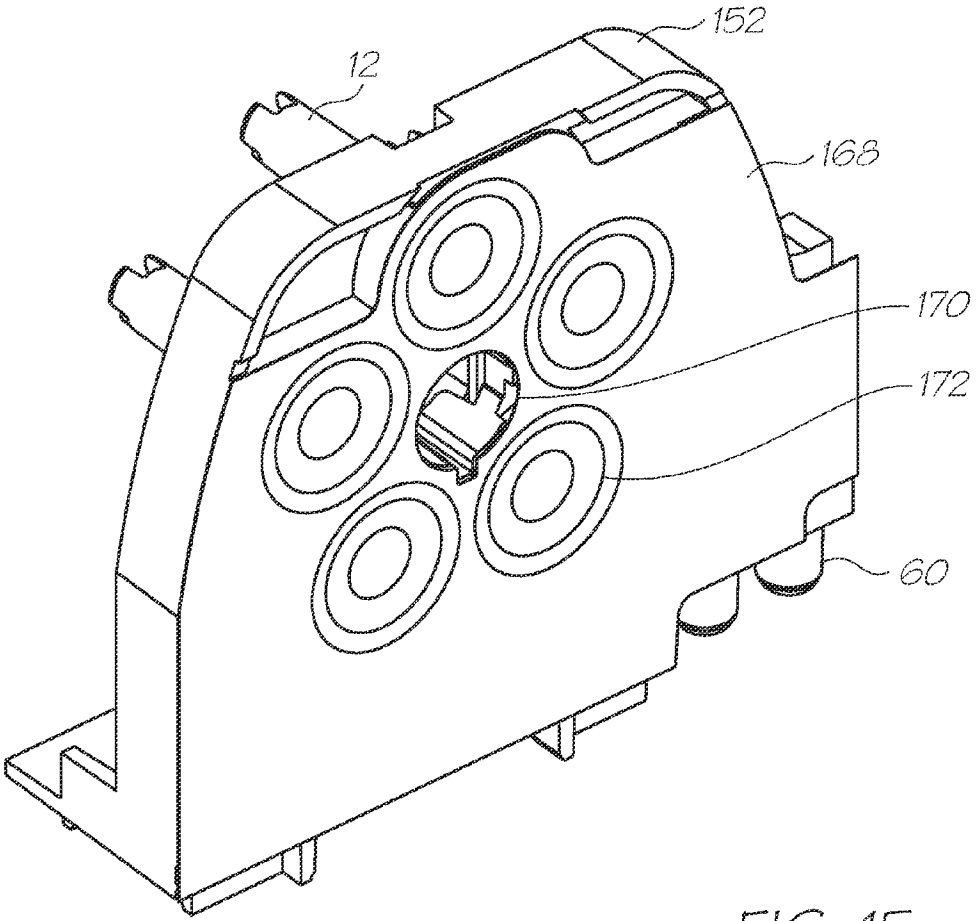
FIG. 15 is a perspective of the ink manifold of FIG. 13.
Figure 16:
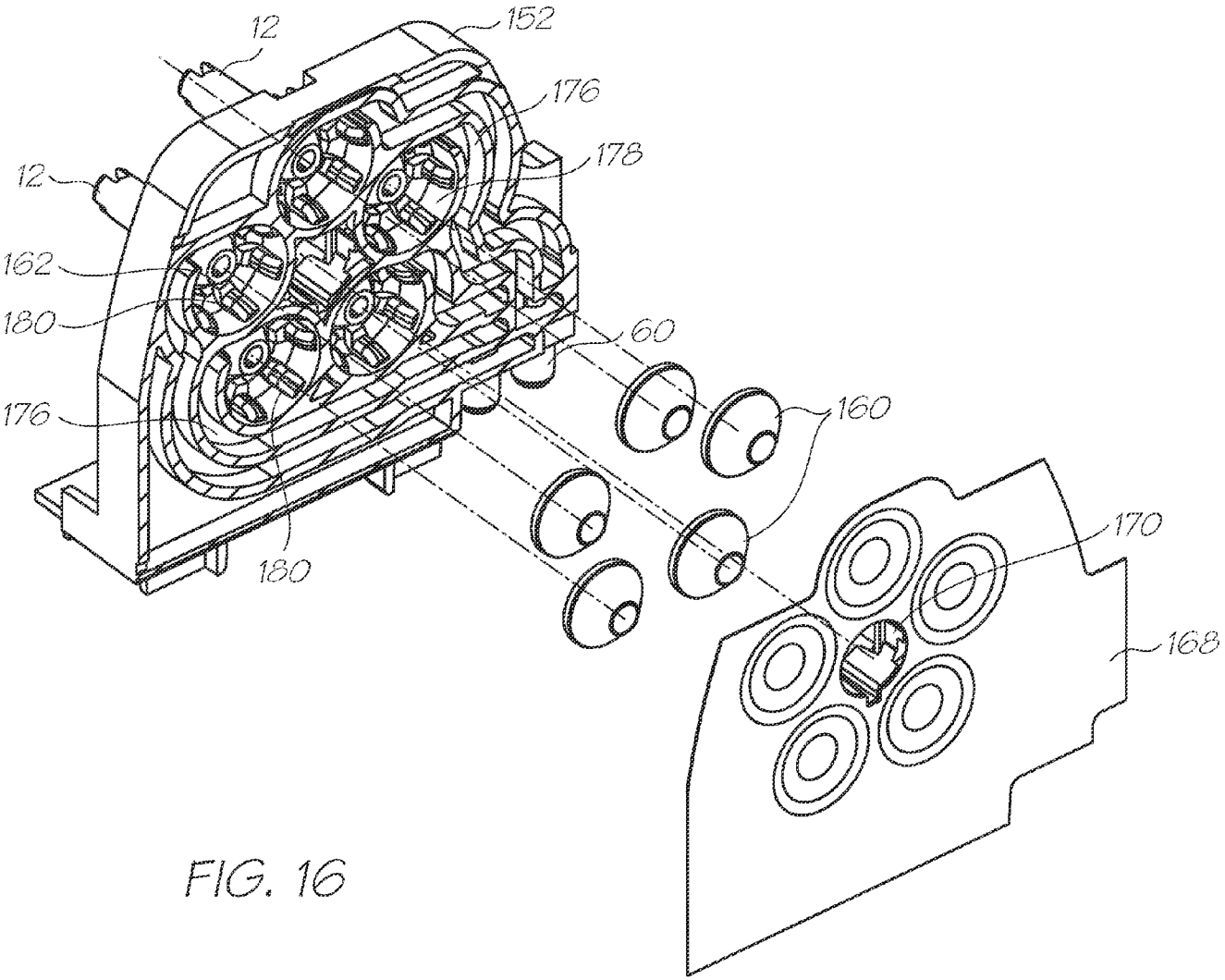
FIG. 16 is an exploded perspective of the ink manifold of FIG. 13.

FIG. 16 is an exploded view of the perspective shown in FIG. 15. With the sealing film 168 and the shut off valves 160 removed, the features of the valve chambers 178. The openings 162 extend into the chambers 178 for contact with the sealing cap 164. The sealing cap 164 and the collapsible section 166 are held in position by a series of ribs 180. The ribs 180 also create gaps between the shut off valve 160 and the side walls of the chamber 178 to provide a flow path for the ink.

Each of the valve chambers 178 feeds one of the channels 176 respectively. The channels 176 lead to the connector 60 which in turn feeds the LCP channels 4 (see FIG. 10). The channel 176 connects to the corresponding valve chamber 178 at its most elevated point. This avoids the top of the chamber becoming a bubble trap as the manifold primes with ink.

Figure 18:
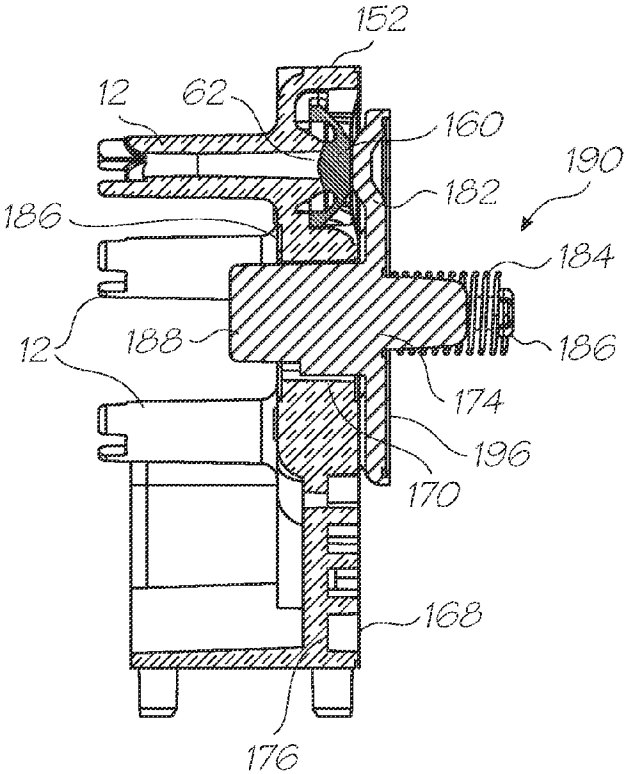
FIG. 18 is Section 18-18 shown in FIG. 17.
Figure 17:
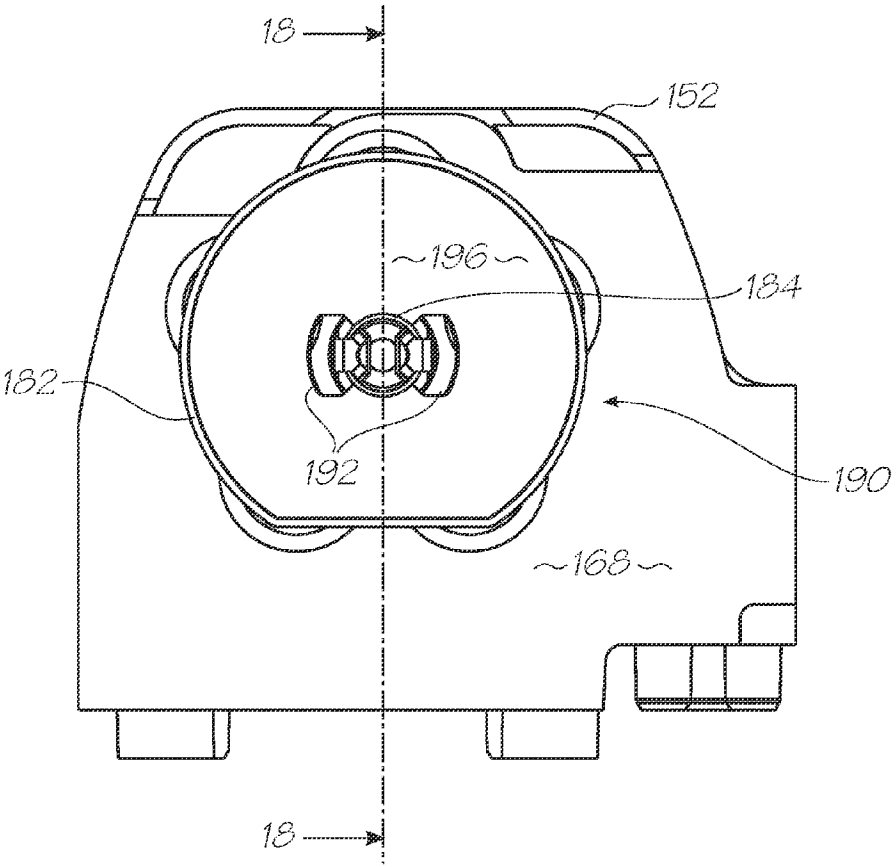
FIG. 17 is an elevation of the ink manifold with the shut off valve actuator.
Figure 19:
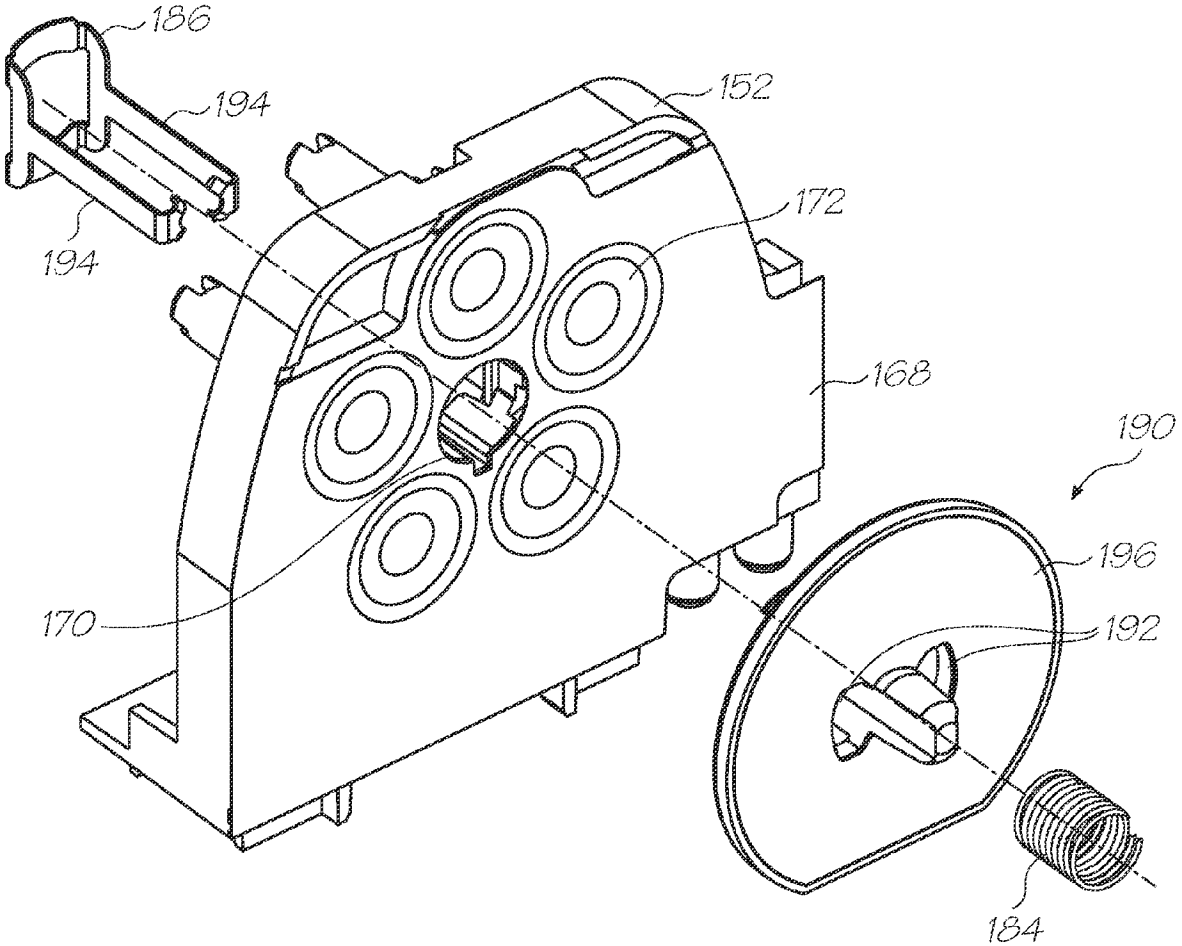
FIG. 19 is an exploded perspective of the ink manifold together with shut off valve actuator.

FIGS. 17, 18 and 19 illustrate the structure and function of the valve actuator 190. A polymer flange body 174 extends through a central aperture 170 in the channel molding 152 and the sealing film 168. An abutment face 188 extends proud of the front face of the channel molding 152. Flange 182 sits on the exterior of the sealing film 186 on the rear face of the channel molding 152. A metal plate 196 reinforces the back of the flange 182. The sealing film 168 is protected from any sharp burrs on the plate 196 by the flange 182.

A metal spring cage 186 fits over the abutment face 188 and seats against the front face of the channel molding 152. The metal spring cage 186 has a pair of arms 194 that extend through the central aperture 170, the holes 192 in the flange 182 and the metal plate 196. The arms 194 hook over one end of a steel compression spring 184. The other end of the spring 184 sits on the plate 196. The spring is held in compression such that plate 196 and the flange 12 press all the shut off valves 160 to the closed position. It will be appreciated that the compressive force of the spring 184 needs to exceed the bias of the shut off valves 160.

As discussed above, the compression members are the interface between the printer and the printhead cartridge. Referring back to FIGS. 3 and 4, the compression member 18 advances onto the spouts 12 to form a connection with the second conduits 14 and the ink supply. As the compression member 18 advances towards the ink manifold 148, it pushes on the abutment surface 188 to further compress the spring 184 and draw the flange 182 away from the shut off valves 160. The tolerances for the engagement of the compression member 18 and the ink manifold 148 are much higher than the tolerances on the operation of the shut off valves 160. However, the flange 182 completely disengages from the shut off valve 160 so any variation in the travel of the compression member 18 is isolated from the shut off valves 160. Shut off valves are normally biased closed to provide a fluid seal as soon as the fluid coupling is disconnected. However, the ink manifold according to this invention achieves the same shut off action with valves that are biased open such that they can operate independent of the closing actuator.

The above embodiments are purely illustrative and not restrictive or limiting on the scope of the invention. The skilled worker will readily recognize many variations and modifications which do not depart from the spirit and scope of the broad inventive concept.

The invention claimed is:

1. A printhead cartridge for releasable mounting in a printer, said printhead cartridge comprising:

a pagewidth printhead; and an ink manifold defining multiple fluid flow paths in fluid communication with respective ink channels in the printhead, said ink manifold comprising:

a plurality of openings arranged for detachable connection with conduits in an interface of the printer;

a plurality of shut off valves at each of the openings respectively, each shut off valve comprising a biasing member configured for biasing each shut off valve into an open position; and an actuator biased towards a closed position by a resilient element such that the actuator holds all the shut off valves closed when in the closed position, the bias of the resilient element being greater than the combined biases of each biasing member of the ink manifold;

wherein the actuator is configured for engagement with the interface such that movement of the openings into connection with the interface simultaneously moves the actuator to an open position wherein the shut off valves are held open.

2. The printhead cartridge according to claim 1, wherein the fluid flow paths are partially defined by a polymer channel molding having an arrangement of channels and a flexible polymer film sealed over the channels to seal the fluid flow paths from each other, the shut off valves being sealed within the polymer channel molding by the flexible polymer film and the actuator being configured to act on an external surface of the flexible polymer film at areas adjacent the shut off valves.

3. The printhead cartridge according to claim 2 wherein the flexible sealing film is polypropylene film foil.

4. The printhead cartridge according to claim 1, wherein the shut off valves are each resilient caps fitted to the respective peripheries of each of the openings by an integrally molded collapsible section such that the resilient cap is spaced from the opening until pressure from the actuator collapses the collapsible section and the cap seals against the opening periphery.

5. The printhead cartridge according to claim 4, wherein the shut off valves are formed from a synthetic rubber.

6. The printhead cartridge according to claim 2, wherein the flexible polymer film has plastically deformed areas adjacent each of the shut off valves, the plastically deformed areas extending out of the plane of the polymer sealing film and configured to invert to accommodate movement of the shut off valves.

7. The printhead cartridge according to claim 6, wherein the channel molding defines a plurality of valve chambers for holding each of the shut off valves respectively, the valve chambers each connecting to one of the channels respectively, such that the channel connects to the valve chamber at a topmost section when the manifold is in use.

8. The printhead cartridge according to claim 1 comprising two of said ink manifold positioned at opposite ends of the pagewidth printhead, one being an inlet manifold and the other being an outlet manifold.

9. The printhead cartridge according to claim 1, wherein each manifold comprises a plurality of spouts extending parallel with a media feed direction defined by the pagewidth printhead.

* * * * *